United States Patent [19]

Inglis

[11] 4,046,492

[45] Sept. 6, 1977

[54] AIR FLOW AMPLIFIER

[75] Inventor: Leslie R. Inglis, Cincinnati, Ohio

[73] Assignee: Vortec Corporation, Cincinnati, Ohio

[21] Appl. No.: 651,193

[22] Filed: Jan. 21, 1976

[51] Int. Cl.[2] ..... F04F 5/00

[52] U.S. Cl. ..... 417/197

[58] Field of Search ..... 137/604; 417/197

[56] References Cited

U.S. PATENT DOCUMENTS

| | | | |
|---|---|---|---|
| 857,768 | 6/1907 | Stirling | 417/197 |
| 3,047,208 | 7/1962 | Coanda | 417/197 X |
| 3,664,768 | 5/1972 | Mays et al. | 417/197 |

FOREIGN PATENT DOCUMENTS

| | | | |
|---|---|---|---|
| 3,275 of | 1878 | United Kingdom | 417/197 |

*Primary Examiner*—Robert G. Nilson

*Attorney, Agent, or Firm*—Tilton, Fallon, Lungmus, Chestnut & Hill

[57] ABSTRACT

An air flow amplifier of relatively high air flow amplification ratios in which a thin film of pressurized primary air flowing in a transverse direction is mechanically deflected to impinge on a generally frusto-conical surface tapering towards the throat of the amplifier. The deflecting action is produced by a deflection ring which is spaced inwardly from the amplifier's annular nozzle. The ring has an internal diameter substantially larger than the amplifier's throat so that secondary air entering through the ring may flow directly towards the frusto-conical surface to mix with the primary air flowing along that surface.

11 Claims, 4 Drawing Figures

AIR FLOW AMPLIFIER

BACKGROUND

The Coanda effect as used in air flow amplifiers to achieve high amplification ratios is well known. As disclosed in U.S. Pat. No. 2,052,869, the Coanda effect involves discharging a small volume of fluid (primary fluid) under high velocity from a nozzle, the nozzle being immediately adjacent a shaped surface. The primary fluid tends to follow the shaped surface and as it does so it induces surrounding fluid (secondary fluid) to flow with it. In an air flow amplifier, a small volume of primary fluid is therefore used to move a much larger volume of secondary fluid, the amplification ratio being the total volume of primary and secondary fluid discharged from the device in relation to the volume of primary fluid supplied.

Other types of fluid or air moving devices, commonly called ejectors, are also well known. In general, such ejectors have been used to create relatively high suction and have therefore been used effectively as pumps. Characteristically, such ejectors are capable of only limited air flow amplification but that failing is not of major concern in a device intended primarily to generate high suction. Where high amplification has been required, Coanda-type amplifiers have been available and have generally been regarded as the more effective means for achieving high amplification ratios.

Unfortunately, air flow amplifiers which operate on the Coanda principle do have certain disadvantages. Since some of the kinetic energy in the primary stream must be used to turn that stream (and also a part of the secondary stream), the Coanda profile must be machined carefully for optimum performance. Also, Coanda amplifiers are particularly sensitive to back pressure at the outlet and, as this pressure is increased, it can cause a sudden detachment of the primary stream from the profile, resulting in turbulence and flow reversal in the suction inlet area. Efforts to reduce the flow reversal characteristics, so that reversal occurs only at higher exit pressures, have had the effect of substantially reducing the amplification ratios (see, for example, U.S. Pat. No. 3,801,020).

The term "high amplification ratio" is used herein to mean ratios of 10:1 or better. A well-designed and fabricated Coanda amplifier might achieve amplification ratios of 15:1 for example. By contrast, a typical ejector of the type used to create a vacuum in steam condensers would be expected to have an amplification ratio in the order of about 3:1.

Other references illustrating the state of the art are U.S. Pat. Nos. 2,713,510, 2,920,448, 3,047,208, 2,120,563, and 3,795,367.

SUMMARY

One aspect of this invention lies in the discovery that an air flow amplifier may be constructed which is capable of amplification ratios equal to or even greater than a Coanda-type amplifier of the same size (throat area) without the complexities (and relatively high expense) of construction commonly associated with Coanda amplifiers and without, in fact, even utilizing the Coanda principle. Specifically, this invention concerns a non-Coanda amplifier of relatively simple construction which has remarkably high air flow amplification characteristics.

Briefly, the amplifier consists of a body formed of two main parts joined together with a non-compressible gasket therebetween. An axial flow passage extends through the body, the passage including an inlet section, an outlet section, and an intermediate section. The passage-defining surface of the intermediate section is frusto-conical in shape and terminates at the outlet section in a throat of reduced cross sectional area. An annular nozzle is disposed between the inlet and intermediate sections for discharging radially inwardly a thin film of primary air. That film is deflected by a lip or deflector ring which is disposed within the main flow passage and which is spaced a substantial distance inwardly from the annular nozzle. The deflector ring serves as a baffle to deflect the film of pressurized air towards the frusto-conical surface of the intermediate section. Since the ring has a substantially larger internal diameter than the throat of the amplifier, secondary air passing through the ring also flows towards the frusto-conical surface where it is impacted and mixed with the deflected and redirected primary air.

The annular nozzle takes the form of a narrow planar slit or flow passage which extends along a transverse plane, that is, a plane normal to the axis of the amplifier. Since the slit is defined by planar opposing surfaces of the two parts of the body, and since the width of the slit may be precisely determined by the selection of a non-compressible gasket of proper thickness, a highly effective but relatively inexpensive assembly is achieved.

Primary air passing through the slit is of constant velocity because the width of the slit is constant. The constant-width passage terminates abruptly in an annular nozzle outlet. The air discharged radially inwardly from the annular nozzle continues at substantially the same high velocity because of the abrupt discontinuance of the nozzle passage and because the radially moving air film does not expand axially (of the amplifier) to an appreciable extent. Deflection of that film by the deflector ring, and subsequent impingement of the deflected film against the frusto-conical surface, are also achieved with minimal losses (at most) in primary flow velocity, the continued high velocity of the primary air film in the zone of interaction with secondary air being attributable at least in part to the narrowing of the passage leading to the amplifier's throat. Highly effective intermixing and entrainment occurs because of the continued high velocity of the primary air and because the deflected primary air continues as a thin film which is capable of more complete intermixing with secondary air than a relatively wide primary stream having only a boundary layer portion which so interacts.

Other advantages, features, and objects of the invention will become apparent from the specification and drawings.

DRAWINGS

DESCRIPTION

Figure 1:
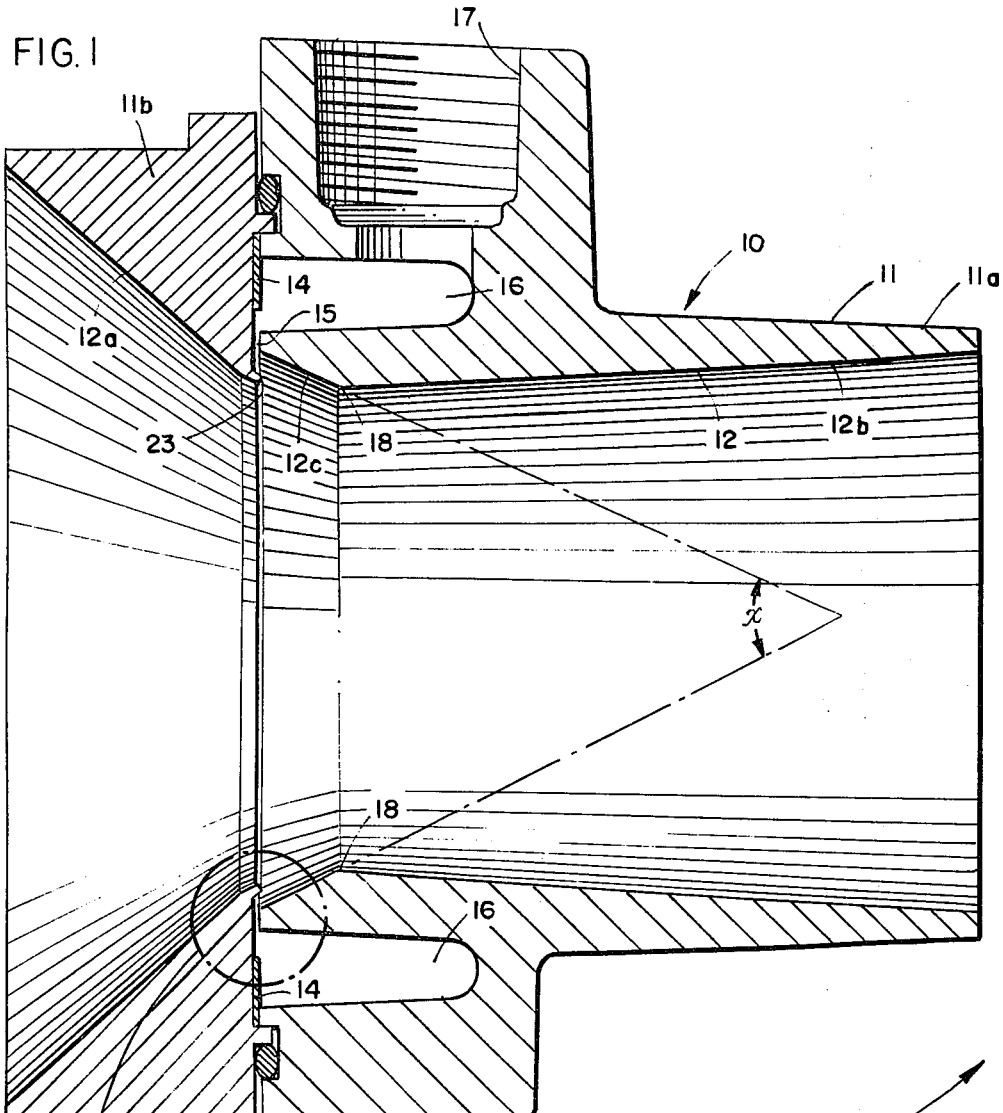
FIG. 1 is a longitudinal sectional view of an air flow amplifier embodying the present invention.

Referring to the drawings, the numeral 10 designates an air flow amplifier having a body 11 defining an air flow passage 12 therethrough. The passage is preferably circular in transverse section and is composed of three main sections, specifically, an inlet section 12*a*, an outlet section 12*b* and an intermediate section 12*c*.

Fabrication is greatly facilitated by forming the body in two main parts 11*a* and 11*b*, joined together by screws 13 or by any other suitable means, with a non-compressible spacer or gasket 14 disposed therebetween for controlling the width of annular nozzle passage 15. The nozzle passage extends radially inwardly along a transverse plane from an annular chamber 16 formed in section 11*a* of the amplifier body. The chamber communicates with threaded inlet 17 which is adapted for connection to any suitable source of compressed air. As is well known, compressed air lines as used in industry normally carry air pressurized between 50 to 100 pounds per square inch gauge (psig), the more common range being 60 to 80 psig.

The intermediate section 12*c* of the flow passage 12 is generally frusto-conical in configuration, tapering inwardly in the direction of outlet section 12*b*. The slope of convergence of surface 12*c* may vary considerably depending on factors such as fluid pressure, nozzle width, throat diameter, and the nature of the particular fluids involved. In general, the included angle $x$ should fall within the range of 10° to 70°, the preferred range being 45° to 55°.

The converging surface of the passage's intermediate section 12*c* merges with the surface of outlet section 12*b*, the junction of the two defining throat opening 18. It will be observed that the smallest transverse cross section of passage 12 occurs at throat opening 18. While the surface 12*b* of the outlet section is shown as flaring outwardly, terminating in an outlet 19 which is larger than throat 18, the main requirement is that the throat be no larger than any other portion of the passage. The surface of the outlet section 12*b* might therefore be cylindrical in configuration for some applications, although in general it is preferable to have the outlet section flare gradually outwardly as shown.

Figure 2:
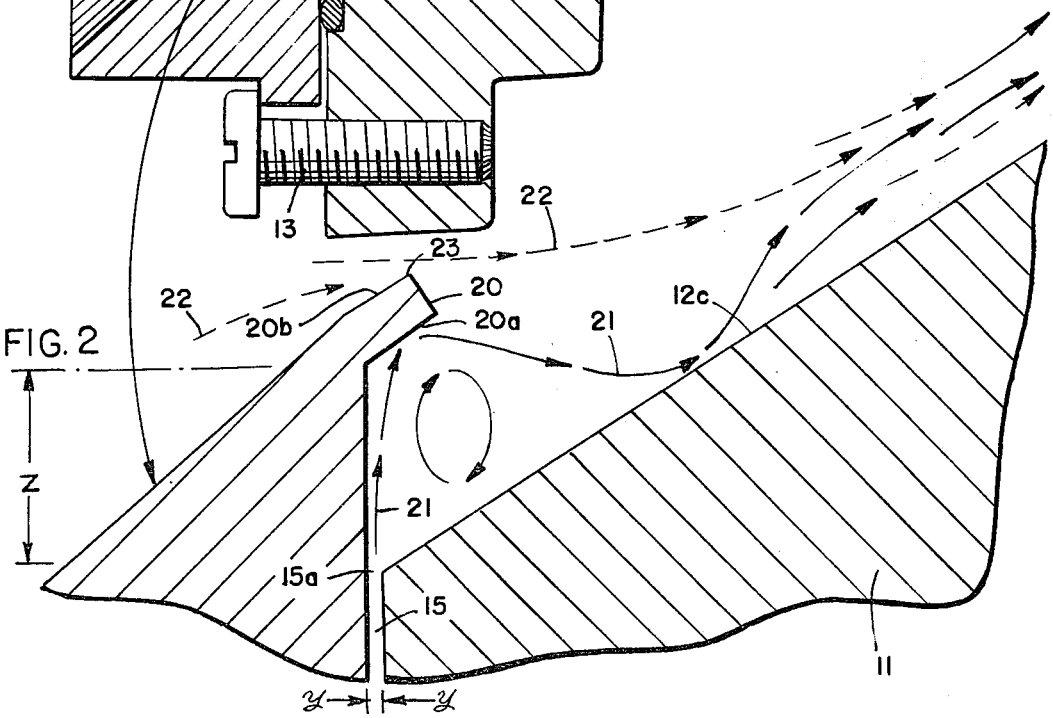
FIG. 2 is a greatly enlarged sectional view of a portion of the structure, the area of enlargement being indicated generally in FIG. 1.

The annular nozzle passage or slit 15 defines the upstream boundary of intermediate section 12*c*. Referring to FIG. 2, it will be noted that the nozzle passage 15 terminates in an annular nozzle opening 15*a* immediately adjacent the commencement of converging surface 12*c*. The slit or passage 15 is of substantially uniform width $y$ throughout its radial extent, such width being determined by the thickness of spacer 14 as already described. The spacer may be formed of metal or any other generally non-compressible material, the thickness of that material, and the resultant width of the nozzle passage, varying considerably depending upon the size of the unit as a whole, the fluids involved, the pressure of the primary fluid, etc. As an example, with a unit having a throat diameter of 1.58 inches, and operating under primary air pressures of 60 to 80 psig, a nozzle width of 0.002 of an inch has been found particularly effective.

Since the nozzle slit 15 extends along a transverse plane, primary air discharged from the nozzle outlet 15*a* flows radially inwardly in a thin film until it impinges upon the outer surface 20*a* of a deflecting ring or lip 20. Surface 20*a* deflects the film in a generally axial direction towards the intermediate sections converging frusto-conical surface 12*c*. Such converging surface again redirects the film towards throat 18. The flow path of the film of primary air is somewhat diagramatically represented in FIG. 2 by solid arrows 21 whereas the path of secondary or ambient air from the inlet section 12*a* is represented by dashed arrows 22.

The ring or lip 20 is an extension of body section 11*b* and is preferably formed integrally therewith. It is spaced a substantial distance $z$ from nozzle outlet 15*a* — a distance at least three times the width $y$ of the nozzle. While distance $z$ may be substantially greater than that (as shown), it is important that it not be so large as to cause the lip to shadow, in terms of secondary fluid flow, the throat 18 of the amplifier. Stated differently, the inside diameter of the lip defines the entrance 23 for the flow of secondary fluid into the amplifier and that inside diameter must be substantially larger than the diameter of throat opening 18.

The result is that some of the secondary fluid entering the amplifier through entrance 23 flows directly towards the frusto-conical surface of intermediate section 12*c* (along path indicated by arrows 22) and towards the film of primary air deflected and redirected by lip 20 and surface 12*c* (as represented by arrows 21). Highly effective entrainment and intermixing of primary and secondary air therefore occurs along that portion of surface 12*c* adjacent to throat opening 18. Such intermixing is promoted by the tendency of the air discharged from nozzle opening 15*a* to remain as a film, without appreciable loss in velocity, even after it has been deflected by lip surface 20*a* and redirected by converging surface 12*c*. Because of the tendency to remain as a film as it approaches throat 18 and even beyond that throat, most of the primary air is available for direct contact or impact with secondary air to provide an efficient unit of relatively high flow amplification ratios.

Figure 3:
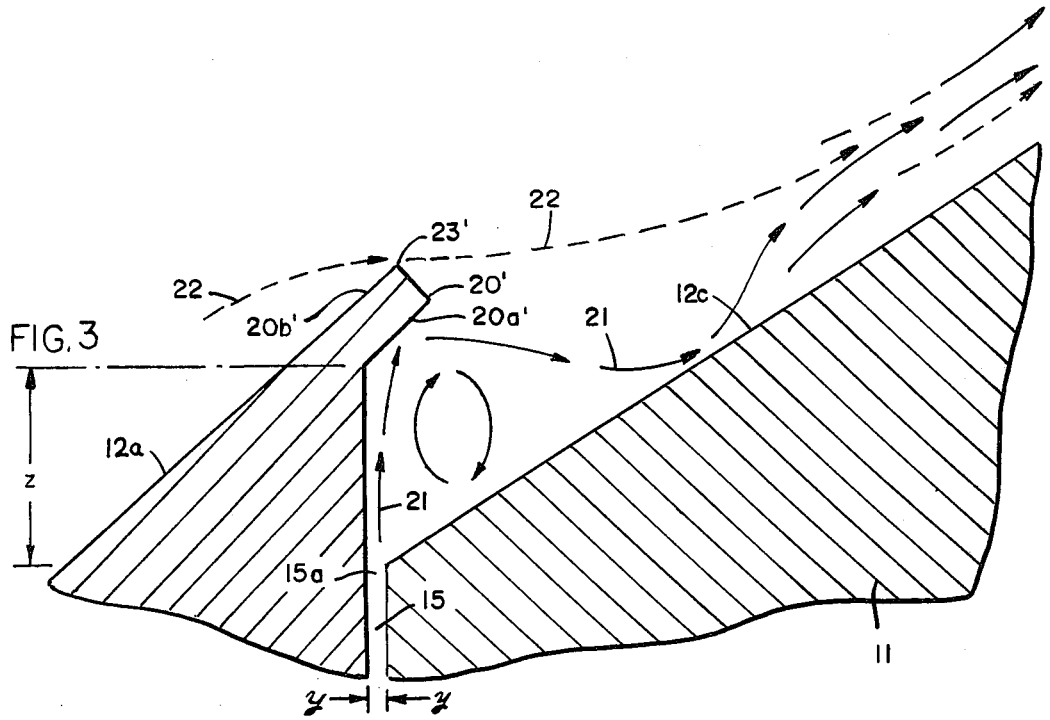
FIG. 3 is an enlarged sectional view similar to FIG. 2 but showing a second form of the invention.
Figure 4:
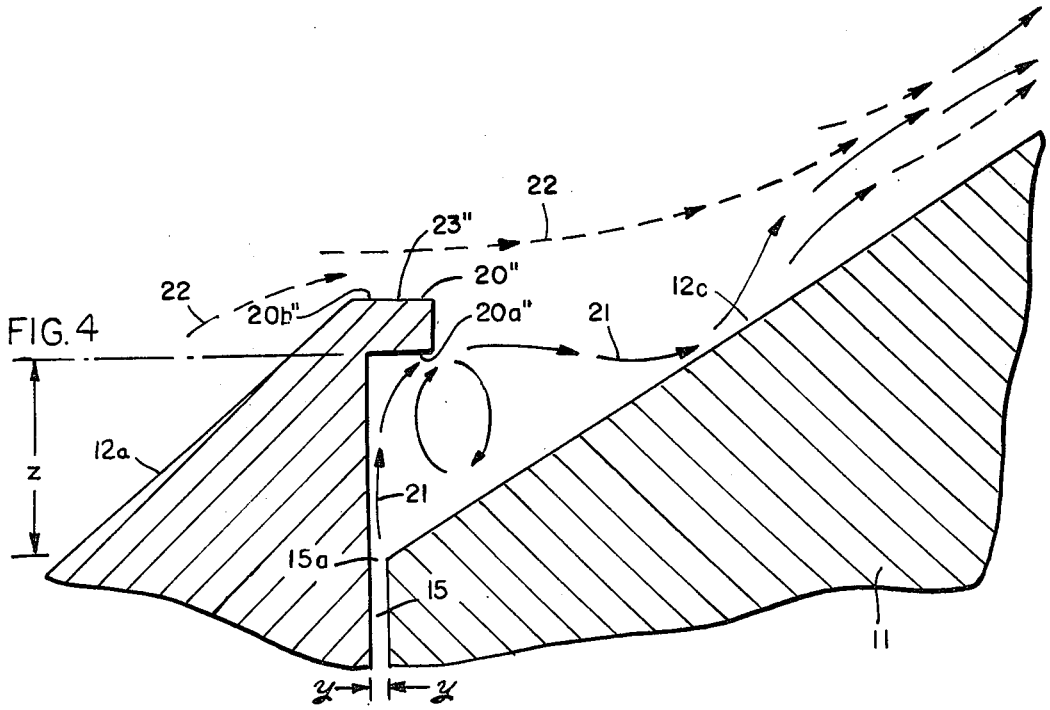
FIG. 4 is an enlarged sectional view similar to FIGS. 2 and 3 but showing a third form of the invention.

The angle of deflecting surface 20*a* is not critical as long as it is operative to deflect the film of primary air towards the sloping redirecting surface 12*c*. Thus, the deflecting surface may taper or slope inwardly in a direction generally parallel with surface 12*c*, as represented by surface 20*a* in FIG. 2 or it may have even a greater inward slope as represented by surface 20*a*′ in FIG. 3. Alternatively, the deflecting surface may be of a lesser angle than redirecting surface 12*c* and may even be cylindrical, as also represented by surface 20*a* in FIG. 4. Such variations do not appreciably alter the performance characteristics of the amplifier as long as each surface 20*a*, 20*a*′ or 20*a*″ is positioned in transverse alignment with nozzle 15 and is oriented to deflect the film of discharged primary air towards the sloping redirecting surface 12*c*.

The inner surface 20*b* of lip or ring 20 may also be varied in angle although it is apparent that the included angle defined by that surface should not be greater than the angle of the remainder of inlet section 12*a*; otherwise, the lip would have the effect of directing secondary air away from surface 12*c*. Thus, the inner surface may have the same slope as that of surface 12*a*, as represented by surface 20*b*′ in FIG. 3 or, on the other hand, may be cylindrical as represented by surface 20*b*″ in FIG. 4. Furthermore, the particular angle of inlet surface 12*a* may be greater or less than as shown and, if desired, may be curved in longitudinal section to provide a flared intake for secondary flow. Except for the differences in the angle of lips or rings 20, 20′, and 20″, and the respective surfaces of those lips, the forms illustrated in FIGS. 1 through 4 are identical.

The result is an air flow amplifier which deflects and redirects primary air from a radially-facing nozzle and towards a reduced throat opening to insure impingement and interaction of primary and secondary air and to produce a highly efficient amplifier having relatively high flow amplification ratios. It has been found that such an amplifier is capable of achieving amplification ratios at least as high, and in many cases considerably higher, than those achieved by amplifiers of corresponding size utilizing the Coanda principle. For example, a commercially-available Coanda-type amplifier, having a throat diameter of 1.58 inches and operating from a source of primary air at 60 psig, has been found to have an amplification ratio of approximately 15:1. By comparison, an amplifier constructed in accordance with this invention, having the same throat diameter and operating under the same pressure conditions, has been found to have an amplification ratio of approximately 19:1.

Throughout the specification, the amplifier has been referred to as an "air" flow amplifier because its main use concerns the amplification of flow using air from conventional pressure lines as the primary fluid. It is to be understood, however, that fluids other than air may be used as the primary and/or secondary fluids.

While in the foregoing an embodiment of this invention has been disclosed in considerable detail for purposes of illustration, those skilled in the art will realize that such details may be varied without departing from the spirit and scope of the invention.

I claim:

1. A fluid flow amplifier of relatively high amplification ratio, comprising a body having surfaces defining an axial flow passage therethrough; said passage including an inlet section, an outlet section, and an intermediate section therebetween; the surface of said intermediate section being frusto-conical in shape and terminating at said outlet section in a throat opening of reduced cross section; said body also having means defining a constantly open annular nozzle between said inlet and intermediate sections for injecting a thin continuous film of pressurized fluid inwardly into said passage along a transverse plane; and a deflector ring disposed within said passage and intersecting said transverse plane; said ring having an outer surface spaced inwardly from said nozzle for contacting the film of pressurized fluid discharged transversely inwardly by said nozzle and for deflecting said film axially towards the frusto-conical surface of said intermediate section; said ring also having an inner surface adjoining the surface of said inlet section and defining an opening substantially larger than said throat opening.

2. The amplifier of claim 1 in which said outer surface of said ring is spaced from said nozzle a distance at least three times the axial dimension of said annular nozzle.

3. The amplifier of claim 1 in which said outer surface of said ring is frusto-conical and tapers inwardly towards said outlet section.

4. The amplifier of claim 1 in which said outer surface of said ring is generally cylindrical.

5. The amplifier of claim 1 in which said frusto-conical surface of said intermediate section has an included angle falling within the range of 10° to 70°.

6. The amplifier of claim 5 in which said included angle falls within the range of 45° to 55°.

7. The amplifier of claim 1 in which said means also defines a planar flow passage for pressurized fluid extending along said transverse plane and terminating at its innermost limits in said annular nozzle, said planar flow passage being of uniform width measured axially of said body.

8. The amplifier of claim 1 in which said surface of said inlet section is generally frusto-conical and tapers inwardly towards said inner surface of said ring.

9. The amplifier of claim 8 in which said inner surface of said ring is frusto-conical and of substantially the same slope as that of the surface of said inlet section.

10. The amplifier of claim 8 in which said inner surface of said ring is frusto-conical and has a slope having an included angle less than that of the surface of said inlet section.

11. The amplifier of claim 8 in which said inner surface of said ring is generally cylindrical.

* * * * *